US006020021A

United States Patent [19]

Mallory, Jr.

[11] Patent Number: 6,020,021

[45] Date of Patent: Feb. 1, 2000

[54] METHOD FOR DEPOSITING ELECTROLESS NICKEL PHOSPHORUS ALLOYS

[76] Inventor: Glenn O. Mallory, Jr., c/o Electroless Technologies, 3860 Cloverdale, Los Angles, Calif. 90008

[21] Appl. No.: 09/141,610

[22] Filed: Aug. 28, 1998

[51] Int. Cl.[7] ..... B05D 5/12

[52] U.S. Cl. ..... 427/98; 427/305; 427/438; 427/443.1

[58] Field of Search ..... 106/1.22, 1.27; 427/98, 305, 438, 443.1

[56] References Cited

U.S. PATENT DOCUMENTS 4,397,812 8/1983 Mallory .
4,483,711 11/1984 Harbulak et al. ..... 106/1.22
5,258,061 11/1993 Martyak et al. ..... 106/1.22

OTHER PUBLICATIONS

Robert M. Smith and Arthur E. Martell, Critical Stability Constants, Plemumn Press, New York vol. 5 First Supplement no month available 1982 p. 329.

*Primary Examiner*—Brian K. Talbot
*Attorney, Agent, or Firm*—Alan M. Abrams

[57] ABSTRACT

Method for plating an electroless nickel phosphorus containing alloy deposit on a substrate where the deposit has a high weight percent of phosphorus above 8 or 10 weigh percent and is plated at high deposition rates above 10 and up to 25 micrometers per hour and where the plating deposition is conducted in the presence of a nickel chelating agent having a stability constant, log $K_a$, above 3 such as citric acid and at a pH of from about 5.0 to about 8.0.

9 Claims, No Drawings

METHOD FOR DEPOSITING ELECTROLESS NICKEL PHOSPHORUS ALLOYS

This invention relates to a method for preparing electroless nickel phosphorus containing alloys. More particularly, this invention relates to a method for preparing electroless nickel phosphorus containing alloys as plated deposits or coatings on various substrates wherein the plated deposit is produced with a high level of phosphorus and with a high deposition rate.

BACKGROUND OF THE INVENTION

Electroless nickel plating, employing phosphorus reducing agents such as hypophosphites, is an established plating method which provides a continuous deposit of a nickel phosphorus alloy coating on metallic or non metallic substrates without the need for an external electric plating current. Such electroless plating method is described generally as a controlled autocatalytic chemical reduction process for depositing the desired metal as a deposit or coating on a suitable substrate. It is simply achieved by immersion of the desired substrate into an aqueous nickel plating bath solution in the presence of a phosphorus containing reducing agent and under appropriate electroless nickel plating conditions.

Phosphorus containing electroless nickel alloys, produced in the electroless nickel plating, are valuable industrial coating deposits having desirable properties such as corrosion resistance and hardness. They are conventionally made in the electroless nickel plating reaction which produces the alloy as a deposit on a suitable substrate such as aluminum to make such commercial items as memory disks. High levels of phosphorus, generally above about 8 to 10 weight percent and up to about 14 weight percent, are often desired for many industrial applications and above about 11 percent for such uses as aluminum memory disks. These high phosphorus levels are usually obtained by conducting the electroless plating at a low pH and usually below a pH of about 4 to 5. At such acid or low pH conditions, however, the deposition rate is slow, and typically in a range below 5 to 10 micrometers per hour ($\mu$m/hr.) Consequently, because of such low deposition rates, a plated deposit having a high phosphorus content above 10 weight percent is relatively costly to produce.

It has now been discovered, however, that phosphorus containing nickel alloys with a high phosphorus content above about 8 to 10 and more desirably above 11 weight percent may be achieved and simultaneously with a high deposition rate above about 10 and above 12.5 to 25 micrometers per hour ($\mu$m/hr.). This result substantially reduces the cost of the plating operation and is effectively and simply realized by conducting the electroless nickel plating in the presence of a particular nickel chelating agent and at a pH of from about 5 to about 8, and preferably of from about 5.5 to about 7.5.

Nickel chelating agents have been conventionally employed in electroless nickel plating and often have been described with a variety of different terms such as stabilizing, complexing, buffering and chelating agents. Such materials generally retard the precipitation of nickel ions from the plating solution as insoluble salts, for example phosphites, by forming more stable nickel complexes with the nickel ions. Conventional complexing and or chelating agents have included glycolic acid (hydroxyacetic acid), lactic acid (2-hydroxypropanoic acid), glycine (aminoacetic acid)and citric acid (2-hydroxy-1,2,3-propanetricarboxylic acid) as well as various soluble salts of such acids. The nickel chelating agents which are used in the method of this invention to achieve a high phosphorus level in the plated deposit and simultaneously with a high deposition rate must be capable of forming an aqueous nickel chelate soluble in the plating solution. Such chelate results from the inter reaction of the nickel ions and the chelating agents in plating solution to form one or more heterocyclic rings having 5 or 6 member rings depending upon the particular chelating agent employed. Such chelating agents to be effective in the method of this invention must have a stability constant, log $K_a$, above about 3 and up to about 10.

Accordingly, an object of this invention is to provide a method for plating an electroless nickel phosphorus containing alloy deposit on a substrate where the deposit plated has a high phosphorus content and is plated at a high deposition rate. Another object is to provide a method for plating an electroless nickel phosphorus containing alloy deposit on a substrate where the deposit plated has a high phosphorus content above about 8 weight percent and is plated at a deposition rate in excess of 10 micrometers per hour. Still another object is to provide a method for plating an electroless nickel phosphorus containing alloy deposit on a substrate where the deposit has a high phosphorus content and is plated in a cost effective procedure using a nickel chelating agent having a stability constant, log $K_a$, in excess of 3. These and other objects of this invention will be apparent from the following further detailed description and examples thereof.

The electroless nickel bath used to practice the method of this invention for plating an electroless nickel phosphorus containing alloy on substrates employs a hypophosphite reducing agent and is operated under electroless nickel plating conditions. In its simplest embodiment the method employs a certain type of a nickel chelating agent within the bath at a certain pH range.

The nickel chelating agents used in the method of this invention have a stability constant, log $K_a$, above about 3 and generally up to about 10. The stability constants, used to characterize suitable chelating agents for achieving high phosphorus levels at high deposition rates in the method of this invention are reflective of or an indication of the thermodynamic character of a nickel complex in aqueous solution or, in effect, the equilibrium constant for the formation of such complex. Such equilibrium constants are stepwise formation constants of the intermediate nickel complexes. They are referred to as stability constants which effectively are a measure of the resistance of the nickel complex to dissociate. They are usually very large numbers and are conventionally reported as logarithmic expressions. The chelating agent molecules donate two or more electron pairs to the nickel ion and are referred to as polydentate ligands. Ligands formed from chelating agents such as lactic acid and glycine are referred to specifically as bidentate ligands while those formed from such chelating agents as malic acid and citric acid are termed terdentate and quadridendate ligands, respectively. Bidentate chelate molecules are added to the nickel ion in a stepwise manner forming a series of nickel-chelate complexes. The addition of a number "n" of chelate molecules to the nickel ion have an associated equilibrium constant $k_n$ where the subscript is an integer representing the number of chelate molecules added to the nickel ion. For example, the stepwise formation of the nickel-glycine complexes involves three equilibrium expressions, each representing the addition of the next glycine molecule as follows:

$$Ni^{+2} + NH_2CH_2COO^- = Ni(NH_2CH_2COO)^+$$

$$K_1 = \frac{[Ni(NH_2CH_2COO)^+]}{[Ni][NH_2CHCOO^-]} = 10^{5.78};\ \log k_1 = 5.78$$

$$Ni(NH_2CH_2COO)^+ + NH_2CH_2COO^- = Ni(CH_2CH_2COO)_2$$

$$K_2 = \frac{[Ni(NH_2CH_2COO)_2]}{[Ni(NH_2CH_2COO)^+][NH_2CH_2COO^-]} = 10^{4.8};\ \log k_2 = 4.8$$

$$Ni(NH_2CH_2COO)_2 + NH_2CH_2COO^- = Ni(NH_2CH_2COO)_3^-$$

$$K_3 = \frac{[Ni(NH_2CH_2COO)_3^-]}{[Ni(NH_2CH_2COO)_2][NH_2CH_2COO^-]} = 10^{3.43};\ \log k_3 = 3.42$$

There is a descending progression in the values of the $K_n$ in any particular system as illustrated in the above nickel-glycine example. The chelating agents suitable for use in the method of this invention are characterized by a stability constant, log $K_a$, where log $k_a$ is the stability constant $K_1$ of the first equilibrium reaction when there are more than one species of nickel chelate complexes formed. It should not be confused with log $k_2$ or log $k_3$ or an overall stability constant log $k_n$ for a series of further equilibrium reactions.

These stability constants are more particularly described in Robert M. Smith and Arthur E. Martell, *Critical Stability Constants*, Vols. 1, 3 and 5 Plenum Press, New York, N.Y. 1982 and Stanley Chaberek and Arthur E. Martell, *Organic Secuestering Agents* John Wiley & Sons, New York, N.Y., 1959. In these references the stability constant, log $K_a$, is referred to as the log k for the first equilibrium reaction [ML]/[M][L] where M is the metal such as nickel and L is the chelating agent such as lactic acid. Illustrative of stability constants, log $K_a$, for certain nickel chelating agents conventionally used in electroless nickel, hypophosphite reduced plating are as follows:

| Chelating Agent | Stability Constant log $K_a$ |
|---|---|
| Glycolic Acid | 1.69 |
| Lactic Acid | 1.64 |
| Malic Acid | 3.16 |
| Malonic Acid | 3.24 |
| Citric Acid | 5.35 |
| DL-Alanine | 5.40 |
| Glycine | 5.76 |
| Aspartic Acid | 7.15 |

As indicated, the nickel chelating agents used in the method of this invention have a stability constant, log $K_a$, above about 3 and up to about 10. The particular chelating agent selected must also not otherwise interfere with the electroless nickel plating reaction or adversely inter react with the other plating bath components. Generally acids may be employed as the nickel chelating agent including carboxylic acids such as mono, di, and tri-carboxylic acids which have a stability constant, log $K_a$, above 3 and generally from 3 to about 7 carbon atoms per molecule. The carboxylic acids may be substituted with various substituent moieties such as hydroxy or amino groups. Illustrative of carboxylic acids having a stability constant, log $K_a$, above 3 and suitable as the nickel chelating agent of the method of this invention include malic acid (hydroxybutanedioic acid), citric (2-hydroxy-1,2,3-propanetricarboxylic acid), glycine (aminoacetic acid), malonic acid (propanedioic acid), aspardic acid (aminosuccinic acid) and DL-alanine (dl-2-aminopropanoic acid). Preferred nickel chelating agents for practicing the method of this invention include malic acid, citric acid or glycine with citric acid being particularly preferred. Such preferred acid chelating agents may also be used in the form of their soluble salts and appropriate anions of such salts include ammonia, or and an alkali metal such sodium. In practicing the method of this invention, the nickel chelating agent is added to the plating bath with the other plating bath components and generally may be present in the bath solution in an amount sufficient to form the desired complex or ligand with the nickel ions in solution. Generally the nickel chelating agent should be present in an amount of from about one to five times the molar concentration of the nickel in the plating solution. Suitable amounts of the chelating agent will typically be within the range of from about 0.02 to about 15.0 mols per liter or preferably from about 0.1 to about 0.5 mols per liter.

The electroless nickel phosphorus containing alloys deposits plated on substrates according to the method of this invention have a phosphorus levels above about 8 to 10 weigh percent and more preferably above about 11 weigh percent and up to about 14 weight percent. Such phosphorus levels are desirable for many industrial applications because of the unique chemical and physical properties of the nickel alloy having such phosphorus content. For example a particular suitable application is an electroless nickel phosphorus containing alloy coated aluminum memory disk.

The electroless nickel plating bath employed to practice the method of this invention, except where discussed herein, may generally employ the conventional methods and techniques used to prepare and operate electroless nickel plating baths. The baths are operated under electroless nickel conditions such as temperature and duration for the particular electroless reaction desired. In a typical procedure, an aqueous bath solution is prepared and added to an appropriate electroless plating vessel. Such aqueous bath solution is usually prepared by adding to water, the desired bath components including the nickel chelating agent such as citric acid, a hypophosphite reducing agent, and a source of nickel cations, for example nickel sulfate. The pH of the bath is adjusted to the appropriate range by the addition of an acid such as acetic acid or a base such as sodium hydroxide and the temperature is adjusted to the desired range followed by immersion of a suitable substrate, appropriately pre-cleaned and treated, into the bath so prepared for a time period or duration so that the nickel phosphorus alloy is deposited by electroless plating onto the immersed substrate.

The substrate employed for such purpose upon which the nickel alloy is coated as a deposit by the electroless plating reaction may be a metal such as aluminum, copper or ferrous alloys or a non-metal such as a plastic or a circuit board which may according to established practice is first surface activated. As indicated, however, one of the unique advantages of the bath according to the method of this invention is that it produces a deposit having a high phosphorus content above about 11 percent and at a high deposition rate. This is particularly advantageous for coating substrates such as aluminum used to manufacture memory disks where high phosphorus content is desirable and where low plating costs requisite.

The pH of the bath according to the method of this invention should be maintained within certain ranges if the desired results, namely, a high phosphorus content and a high deposition rate are to be achieved through use of a specific nickel chelating agent. The pH employed is within the range of from about 5 to about 8, and more preferably within the range of from about 5.5 to about 7.5. The pH within these ranges may be further adjusted depending upon the particular nickel chelating agent employed for the particular plating bath as well as upon the desired phosphorus levels and deposition rates desired. The pH is controlled in typical procedures by adding an acid such as acetic acid or a base such as sodium hydroxide to maintain the desired pH range.

The hypophosphite reducing agent employed in the baths according to method of this invention may be any of those conventionally used for electroless nickel plating such as sodium hypophosphite. The amount of the reducing agent employed in the plating bath is at least sufficient to stoichiometrically reduce the nickel cations in the electroless reaction to free metals and such concentration is usually within the range of from about 0.05 to about 1.0 mols per liter. As in conventional practice the reducing agent may be replenished during the reaction.

The source of the nickel cations employed in the electroless plating of this invention include any of the water soluble or semi-soluble salts of nickel which are conventionally employed. Nickel salts can be added as soluble salts, or salts of low solubility within the particular electroless bath. Typically, suitable sources of the nickel cations are the salts of nickel including sulfates, chloride, sulfamates, acetates or other nickel salts having anions comparable with the electroless system. In conducting the method of this invention, a particularly convenient source of the nickel cation is nickel hypophosphite. Employment of such nickel source additionally provides the hypophosphite reducing agent and allows the use of only one source of two plating bath components instead of two separate sources of the nickel and hypophosphite reducing agent. The concentrations of the nickel cations maintained within the bath may be varied but generally sufficient sources of the nickel cations are within certain preferred ranges. For example, the source of nickel cations should be added to the bath sufficient to provide a concentration of nickel cations within the range of from about 0.02 to about 3.0 mols per liter.

The baths according to this invention may contain in addition to the hypophosphite reducing agent, the nickel chelating agent of the requisite type, and the source of nickel cations, other conventional bath additives such as buffering, complexing, or exaltants as well as stabilizers and brighteners. A description of these other suitable additives is recited in Mallory, U.S. Pat. No. 4,397,812.

The temperature employed for the plating bath is in part a function of the desired rate of plating as well as the composition of the bath. Typically the temperature is within the conventional ranges of from about 25° C. to normal, atmospheric boiling at 100° C., although more preferably below 90° C. and typically within the range of from about 30° C. to 90° C. In selecting the appropriate temperature within these conventional ranges, the plating or deposition rate achieved at any of the temperatures, however, according to the method of this invention will be relatively high for depositing phosphorus containing alloys with high phosphorus content.

Generally, the deposition rates achieved by the method of this invention will be a function of the particular nickel chelating agent employed, the pH range of the bath, the particular bath components and concentrations, the substrate employed for the deposit as well as the bath temperature. Typically when using preferred nickel chelating agents such as citric acid and mild steel substrates, the deposition rate for deposits having phosphorus levels above 8 weigh percent will generally range from above about 10 micrometers per hour up to above about 25 micrometers per hour. The duration of the plating will be in turn be dependent upon the desired thickness of the deposit desired for a given substrate which in turn will be dependent upon the rate of deposition.

The following Examples are offered to illustrate the improved electroless plating methods and baths of this invention and the modes of carrying out such invention:

A series of electroless plating baths were prepared in accordance with conventional procedures using stock solutions prepared for the bath components and utilizing deionized, carbon treated and filtered water and plating grade chemicals.

The baths were formulated as follows:

Bath I

| Constituent | Concentration, Mols/Liter (M) |
|---|---|
| Nickel Sulfate | 0.1 |
| Acetic Acid | 0.5 |
| Sodium Acetate | 0.5 |
| Citric Acid | 0.16 |
| Sodium Hypophosphite | 0.28 |
| pH | 6.8 |
| Temperature | 87° C. |

Bath II

| Constituent | Concentration Mols/Liter |
|---|---|
| Nickel Sulfate | 0.1 |
| Acetic Acid | 0.1 |
| Sodium Acetate | 0.5 |
| Malic Acid | 0.2 |
| Sodium Hypophosphite | 0.2 |
| pH | 7.0 |
| Temperature | 87° C. |

Bath III

| Constituent | Concentration Mols/Liter |
|---|---|
| Nickel Sulfate | 0.1 |
| Acetic Acid | 0.5 |
| Sodium Acetate | 0.5 |
| Glycine | 0.3 |
| Sodium Hypophosphite | 0.3 |
| pH | 6.5 |
| Temperature | 87° C. |

Bath IV

| Constituent | Concentration Mols/Liter |
|---|---|
| Nickel Sulfate | 0.1 |
| Acetic Acid | 0.1 |
| Sodium Acetate | 0.5 |
| Glycolic Acid | 0.2 |
| Sodium Hypophosphite | 0.2 |
| pH | 7.0 |
| Temperature | 87° C. |

| Bath V | |
|---|---|
| Constituent | Concentration Mols/Liter |
| Nickel Sulfate | 0.1 |
| Acetic Acid | 0.1 |
| Sodium Acetate | 0.5 |
| Lactic Acid | 0.2 |
| Sodium Hypophosphite | 0.2 |
| pH | 8.5 |
| Temperature | 87° C. |

Steel panels were prepared according to conventional pre-plating procedures and were plated in four (4) liter baths containing the constituents shown in the above Baths. The pH of the bath was maintained by the addition of dilute sodium hydroxide solution. After plating for one (1) hour the panels were measured to determine the rate of deposition. The composition of the deposits were determined by Energy Dispersive X-ray Spectroscopy. The results of the analysis are summarized in the following Table.

TABLE

| Bath | Chelating Agent | pH | Weight Percent Phosphorus | Deposition Rate μm/hr. |
|---|---|---|---|---|
| I | Citric Acid | 6.8 | 13.5 | 16 |
| II | Malic Acid | 7.0 | 11 | 25 |
| III | Glycine | 7.0 | 8.2 | 16 |
| IV | Glycolic Acid | 7.0 | 5.0 | 20 |
| V | Lactic Acid | 6.8 | 6.80 | 28.75 |

As illustrated in the data summarized in the above Table, the deposits produced in the Baths containing a nickel chelating agent having a stability constant, log $K_a$, above 3, namely Baths I, II, and III using respectively Citric, Malic Acids and Glycine as the chelating agents have very high levels of phosphorus and high plating rates as compared to Baths IV and V using chelating agents having a stability constant, log $K_a$, below 3.

While in the foregoing specification certain embodiments and examples of this invention have been described in detail , it will be appreciated that modifications and variations therefrom will be apparent to those skilled in this art. Accordingly, this invention is to be limited only by the scope of the appended claims.

I claim:

1. A method for plating an electroless nickel phosphorus containing alloy deposit on a substrate where the improvement achieves a weight percent phosphorus above about 11 percent and a deposition rate above about 12.5 micrometers per hour, and comprises conducting the plating deposition in an aqueous bath containing a source of nickel cations, a hypophosphite reducing agent and a nickel chelating agent having a stability constant, log $K_a$, above 3 and operating under electroless nickel plating conditions and at a pH of from about 5.5 to about 7.5.

2. The method of claim 1 wherein the nickel chelating agent is a carboxylic acid having from about 3 to about 7 carbon atoms per molecule.

3. The method of claim 1 wherein the nickel chelating agent is citric acid.

4. The method of claim 1 wherein the nickel chelating agent is malic acid.

5. The method of claim 1 wherein the nickel chelating agent is glycine.

6. The method of claim 1 wherein the nickel chelating agent is present in the bath from about 0.02 mols to about 15.0 mols per liter.

7. The method of claim 1 wherein the hypophosphite reducing agent is sodium hypophosphite.

8. The method of claim 1 wherein the source of nickel cations and the hypophosphite reducing agent is nickel hypophosphite.

9. The deposit produce by the method of claim 1 wherein the phosphorous content is from about 11 to about 14 weight percent and is deposited at a rate of from 12.5 to 25 micrometers per hour.

* * * * *